US007114798B2

(12) United States Patent
Takahashi

(10) Patent No.: US 7,114,798 B2
(45) Date of Patent: Oct. 3, 2006

(54) LIQUID EJECTING APPARATUS

(75) Inventor: Tomoaki Takahashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 120 days.

(21) Appl. No.: 10/676,256

(22) Filed: Oct. 2, 2003

(65) Prior Publication Data

US 2004/0218019 A1 Nov. 4, 2004

(30) Foreign Application Priority Data

Oct. 3, 2002 (JP) ..... 2002-291263
Sep. 19, 2003 (JP) ..... 2003-328151

(51) Int. Cl.
*B41J 2/045* (2006.01)

(52) U.S. Cl. ..... 347/72; 347/68

(58) Field of Classification Search ..... 347/68–72, 347/73

See application file for complete search history.

(56) References Cited

U.S. PATENT DOCUMENTS 5,381,171 A * 1/1995 Hosono et al. ..... 347/72
5,453,770 A * 9/1995 Katakura et al. ..... 347/85
6,664,716 B1 * 12/2003 Cuhat et al. ..... 310/364

FOREIGN PATENT DOCUMENTS

| | | |
|---|---|---|
| JP | 06-079871 A | 3/1994 |
| JP | 06-226971 A | 8/1994 |
| JP | 07-156383 A | 6/1995 |
| JP | 09-174837 | 7/1997 |
| JP | 10-193593 | 7/1998 |
| JP | 2000-211125 | 8/2000 |
| JP | 2001-071486 A | 3/2001 |
| JP | 2003-211661 A | 7/2003 |
| JP | 07-132597 | 5/2006 |

* cited by examiner

*Primary Examiner*—Stepehen Meier
*Assistant Examiner*—Geoffrey S. Mruk
(74) *Attorney, Agent, or Firm*—Sughrue Mion, PLLC

(57) ABSTRACT

The piezoelectric vibrators 33 respectively have the active parts 33*a* capable of performing piezoelectric deformation joined to the elastic walls 26*a* forming one face of each of the pressure chambers 34 via the insular parts. On both sides of the active parts 33*a* in the vibrator width direction perpendicular to the arrangement direction of a plurality of nozzle openings 23, a pair of unit fixing parts 30 and 33*b* are installed. The pair of unit fixing parts 30 and 33*b* are joined to the parts of the flow path unit 21 other than a plurality of elastic walls 26*a*. According to the present invention, without increasing the rigidity of the case for storing the piezoelectric actuator unit, the cross talk is effectively prevented.

10 Claims, 13 Drawing Sheets

LIQUID EJECTING APPARATUS

BACKGROUND OF THE INVENTION

1. Field of the Invention

The present invention relates to a liquid ejecting apparatus for ejecting liquid drops from a nozzle opening thereof. As a typical example of a conventional liquid ejecting apparatus, there is an ink jet recording apparatus having an ink jet recording head for image recording available. As other liquid ejecting apparatuses, for example, an apparatus having a coloring material ejecting head used to manufacture a color filter of a liquid crystal display, an apparatus having an electrode material (conductive paste) ejecting head used for electrode forming of an organic EL display and a face emission display (FED), an apparatus having a biological organic matter ejecting head used to manufacture biological chips, and an apparatus having a sample ejecting head as a precise pipette may be cited.

2. Description of Related Art

An ink jet recording apparatus which is a typical example of a liquid ejecting apparatus produces a comparatively low noise during printing and can form small dots at high density, so that it has been used recently in many printings including color printing.

The ink jet recording apparatus generally has an ink jet recording head (liquid ejecting head) which is loaded on a carriage and moves back and forth in the width direction (head scanning direction) of a recording medium such as recording paper and a feed means for moving the recording medium in the direction (medium feed direction) perpendicular to the head scanning direction.

In this ink jet recording apparatus, ink drops (liquid drops) are ejected from the recording head to the recording medium in correspondence to print data to print it. And, the recording head loaded on the carriage is formed so as to eject ink of colors such as black, yellow, cyan, and magenta, thereby not only text printing by black ink but also by changing the 4-color-ink ejection rate, full-color printing can be carried out.

FIG. 16 is a sectional view showing an example of the recording head of a conventional ink jet recording apparatus.

A recording head 70 has a case 71 made of synthetic resin and a flow path unit 72 stuck on the bottom of the case 71. The flow path unit 72 is formed by laminating and unifying by adhesion a nozzle plate 74 having many bored nozzle openings 73 in two rows, a flow path forming plate 75 made of silicon, an elastic plate 76, and a vibration plate 77. The bottom of the nozzle plate 74 forms a nozzle forming face 78.

The case 71 is a block member having a storing space 79 opened on the top and bottom. In the storing space 79, a pair of right and left piezoelectric actuator units 80 are installed and each of the piezoelectric actuator units 80 is fixed to the inner wall surface of the case 71 by each fixing substrate 81. To each of the actuator units 80, each tape carrier package 83 having a drive integrated circuit 82 is connected.

In the storing space 79, furthermore, as shown in FIGS. 16 and 17, between the pair of right and left piezoelectric actuator units 80, a central rib 84 is arranged. The central rib 84, at both ends thereof in the nozzle arrangement direction (the direction perpendicular to the paper surface of FIG. 16 and the vertical direction of FIG. 17), is fixed to the flow path unit 72. And, a part of the force applied to the flow path unit 72 when the piezoelectric actuator units are driven is received by the central rib 84.

Each of the piezoelectric actuator units 80 has a plurality of piezoelectric vibrators 85 arranged in one row in the nozzle arrangement direction. The piezoelectric vibrators 85 are formed by alternately laminating electrode players and piezoelectric material layers in the direction parallel with the nozzle forming face 78 and vibrate in the direction perpendicular to the lamination direction of both layers.

On the flow path forming plate 75, a plurality of pressure chambers 86 formed in two rows in the nozzle arrangement direction, a common ink chamber 87 formed for each ink kind, and an ink feed port 88 for interconnecting the pressure chambers 86 and the common ink chambers 87 for each of the pressure chambers 86 are formed. The opening on the top of each of the pressure chambers 87 is sealed by the elastic plate 76 and on the top of the part of the elastic plate 76 corresponding to each of the pressure chambers 87, an insular thick part 89 composed of a part of the vibration plate 77 is formed. The part of the elastic plate 76 corresponding to each of the pressure chambers 87 is deformed according to the deformation of the piezoelectric vibrator 85 of the piezoelectric actuator unit 80, thereby the volume of the pressure chamber 86 is changed and ink drops can be ejected from the nozzle opening 73.

In the case 71, an ink feed path 90 for feeding ink to the common ink chambers 87 are formed for each ink kind. The ink feed path 90 passes through the elastic plate 76 and interconnects to the common ink chambers 87.

As FIG. 16 shows, in the recording head of a conventional ink jet recording apparatus mentioned above, the loop of force generated when the piezoelectric vibrators 85 are expanded and contracted is completed only on the side of each of the fixing substrates 81 of the piezoelectric actuator units 80. On the opposite side of each of the fixing substrates 81, the force applied to the flow path unit 72 is received by the central rib 84 of the case 71. However, the rigidity of the central rib 84 is insufficient, so that the force cannot be received sufficiently.

Therefore, for example, in the piezoelectric actuator units 80, when the piezoelectric vibrators 85 are all driven simultaneously, the flow path unit 72 is deformed due to force generated at the time of drive and cross talk is caused. The cross talk produces an ejection characteristic difference between when a small number of piezoelectric vibrators 85 are driven and when a large number of piezoelectric vibrators 85 are driven.

Further, in a conventional recording head, due to deformation of the central rib 84, the deformation is propagated also to the pressure chambers 86 in the opposite side of the drive side and so called inter-row cross talk may be generated.

For example, in Japanese Patent Laid-Open Publication No. 2001-71486, to prevent deformation and vibration of the central rib, a method for inserting a metal into the central rib is proposed (FIGS. 1 and 2 of the publication). By this method, a cross talk prevention effect may be obtained to some extent, though another problem arises that the manufacturing steps are complicated and the manufacturing cost is increased.

Further, as shown in FIG. 16, in the conventional recording head, the fixing substrates 81 are joined to the case 71, so that to the case 71, in addition to the function of ink feed to the flow path unit 72 and protection of the piezoelectric actuator units 80, the rigidity of receiving force generated when the piezoelectric vibrators 85 are driven and of preventing deformation and the high dimensional accuracy for positioning the piezoelectric vibrators 85 with high accuracy are required. Therefore, conventionally, for example, using a material that thermoset epoxy resin is kneaded with a glass fiber as a filler, the case 71 is manufactured by injection molding.

However, use of this manufacturing method causes problems that as compared with a case of general plastics, the material cost is increased, and the molding ability is low due to kneading of a filler, and the yielding rate is reduced, and the manufacturing cost is increased.

Further, the case 71 made of resin is different in the coefficient of linear expansion from the flow path forming plate 75 made of silicon and the piezoelectric vibrators 85. Furthermore, since the case 71 is made of resin, moisture absorption expansion is caused at high humidity. Under such conditions, if the case is made of general plastics, the rigidity thereof is low, so that the case is easily deformed and follows the flow path forming substrate 75 and the piezoelectric vibrators 85 which are highly rigid, thus the members will not be peeled off from each other. However, as mentioned above, since the case 71 is made of a highly rigid material, a problem arises that the case is not deformed easily and the members are peeled off from each other.

SUMMARY OF THE INVENTION

The present invention was developed with the foregoing in view and is intended to provide a liquid ejecting apparatus having a liquid ejecting head capable of effectively preventing cross talk without increasing the rigidity of a case for storing a piezoelectric actuator unit.

The present invention is a liquid ejecting apparatus comprising a liquid ejecting head having a plurality of nozzle openings for ejecting liquid drops arranged in line, wherein: said liquid ejecting head has a flow path unit having a plurality of pressure chambers respectively interconnected to said plurality of nozzle openings, a plurality of elastic walls for respectively forming one face of each of said plurality of pressure chambers, and a nozzle plate where said plurality of nozzle openings are formed and a piezoelectric actuator unit which includes a plurality of piezoelectric vibrators respectively joined to said plurality of elastic walls via insular parts, deforms said elastic walls by deformation of said piezoelectric vibrators, and changes the volume of said pressure chambers, said plurality of piezoelectric vibrators are respectively formed by alternately laminating piezoelectric material layers and electrode layers and have active parts capable of performing piezoelectric deformation which are joined to said elastic walls, and said piezoelectric actuator unit further has a pair of unit fixing parts installed on both sides of said active parts in a vibrator width direction perpendicular to an arrangement direction of said plurality of nozzle openings, and said pair of unit fixing parts are joined to parts other than said plurality of elastic walls of said flow path unit, thereby said piezoelectric actuator unit is fixed to said flow path unit.

Preferably, at least one of said pair of unit fixing parts comprises a plurality of inactive parts incapable of performing piezoelectric deformation formed integrally with said active parts in said vibrator width direction as a part of each of said plurality of piezoelectric vibrators.

Preferably, at least one of said pair of unit fixing parts comprises a fixing member which is formed as a separate member from said plurality of piezoelectric vibrators and is joined to said plurality of piezoelectric vibrators.

Preferably, said fixing member is joined to said plurality of piezoelectric vibrators via a base member joined to said plurality of piezoelectric vibrators.

Preferably, said plurality of piezoelectric vibrators are respectively formed independently and are integrally fixed by said base member.

Preferably, the liquid ejecting apparatus further comprises a tape carrier package electrically connected to said plurality of piezoelectric vibrators, wherein said tape carrier package includes an integrated circuit for driving said plurality of piezoelectric vibrators and a rear of said integrated circuit is fixed to said base member at least partially.

Preferably, said base member is formed by free-cutting ceramics.

Preferably, said piezoelectric material layers and said electrode layers are laminated perpendicularly to said nozzle plate and said piezoelectric vibrators vibrate in a lamination direction of both layers.

Preferably, the liquid ejecting apparatus further comprises a plurality of said piezoelectric actuator units, wherein: a plurality of nozzle rows composed of said plurality of nozzle openings are formed, and said piezoelectric actuator units are respectively arranged for each nozzle row.

Preferably, said plurality of elastic walls comprise a part of an elastic plate covering all of said plurality of pressure chambers, and a plurality of insular movable thick parts which are formed in correspondence with said plurality of pressure chambers and to which respective said active parts of said plurality of piezoelectric vibrators are joined, first fixed thick parts to which said inactive parts of said piezoelectric vibrators are joined, and second fixed thick parts to which said unit fixing parts are joined are installed on a face of said elastic plate on a side of said actuator unit.

Preferably, a total width of said pair of unit fixing parts in said vibrator width direction is wider than a width of said active part in said vibrator width direction.

Preferably, at least one of said pair of unit fixing parts is joined to an end of said active part in said vibrator width direction and parts of said fixing members joined to said ends of said active parts are formed integrally with said plurality of piezoelectric vibrators in a comb-teeth shape.

Preferably, said plurality of nozzle openings are formed in two rows and are staggered between said nozzle rows, and each of said plurality of piezoelectric vibrators includes a half on one side in said vibrator direction and a half on the other side in said vibrator width direction, either of said half on one side and said half on the other side forms said active part, and the other half forms an inactive part incapable of performing piezoelectric deformation, an arrangement of said active part and said inactive part is opposite between adjacent piezoelectric vibrators, and said active parts are arranged in correspondence with said nozzle openings.

As mentioned above, according to the present invention, a liquid ejecting apparatus having a liquid ejecting head capable of effectively preventing the cross talk without increasing the rigidity of the case for storing the piezoelectric actuator units can be provided.

BRIEF DESCRIPTION OF THE DRAWINGS

The foregoing and other objects and features and advantages of the present invention will be understood from the following detailed description in connection with the accompanying drawings.

DESCRIPTION OF THE PREFERRED EMBODIMENTS

An ink jet recording apparatus as an embodiment of the liquid ejecting apparatus of the present invention will be explained below with reference to the accompanying drawings.

Figure 1:
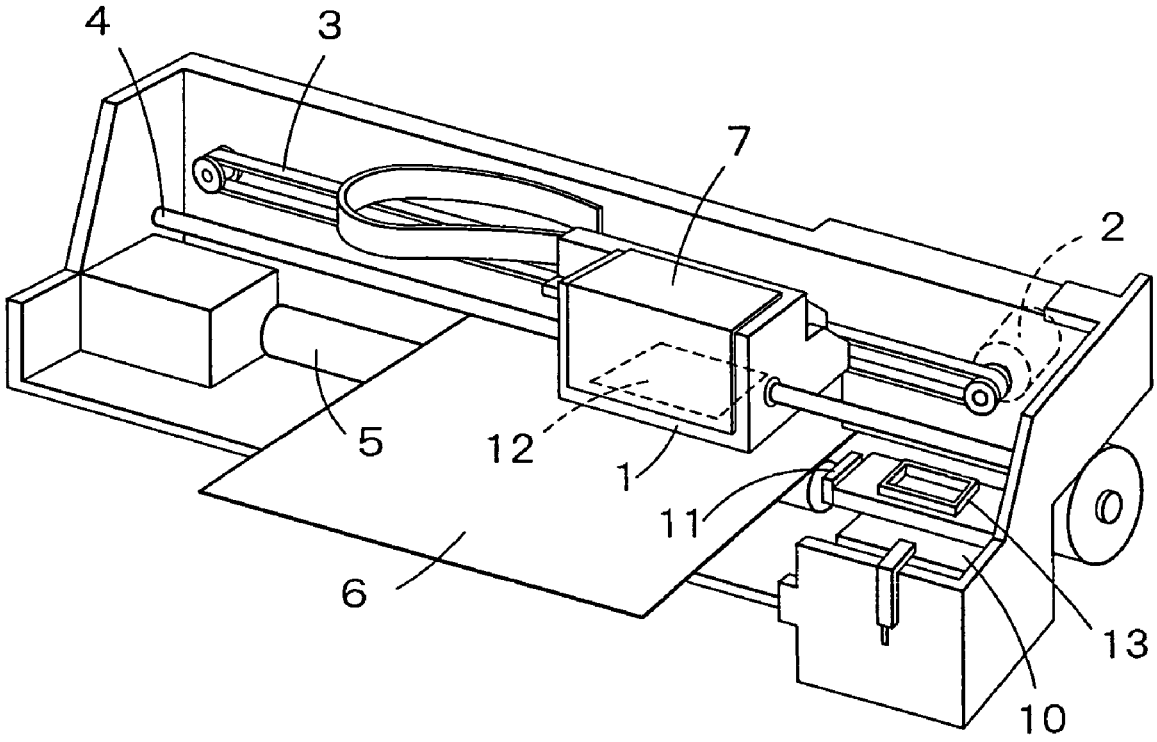
FIG. 1 is a perspective view showing a rough constitution of an ink jet recording apparatus as an embodiment of the liquid ejecting apparatus of the resent invention.

FIG. 1 is a perspective view showing a rough constitution of an ink jet recording apparatus of the present embodiment. In FIG. 1, numeral 1 indicates a carriage, and the carriage 1 is structured so as to be guided by a guide member 4 and driven by a carriage motor 2 via a timing belt 3 to move back and forth in the axial direction of a platen 5. The platen 5 supports recording paper 6 (a kind of recording medium) from the rear thereof and defines the position of the recording paper 6 with respect to an ink jet recording head (liquid ejecting head) 12.

The carriage 1, the carriage motor 2, the timing belt 3, and the guide member 4 form the carriage mechanism for allowing the recording head 12 to scan in the head scanning direction together with the carriage 1.

The recording head 12 is loaded on the side of the carriage 1 opposite to the recording paper 6. On the carriage 1, an ink cartridge 7 for feeding ink to the recording head 12 is mounted in a removable state.

In the home position (the right side of FIG. 1) which is a non-printing area of the ink jet recording apparatus, a cap member 13 is arranged and the cap member 13 is structured so as to be pressed to the nozzle forming face of the recording head 12 and form a closed space between the recording head 12 and the nozzle forming face, when the recording head 12 loaded on the carriage 1 moves to the home position. And, under the cap member 13, a suction pump 10 for giving negative pressure to the closed space formed by the cap member 13 is arranged.

In the neighborhood of the cap member 13 on the printing area side, a wiping member 11 composed of an elastic plate (elastic blade) such as rubber is arranged so as to move back and forth, for example, horizontally for the moving track of the recording head 12 and is structured so as to wipe out the nozzle forming face of the recording head 12 as required, when the carriage 1 moves from the side of the cap member 13 to the printing area side.

The ink jet recording apparatus further has a medium feeding mechanism for intermittently feeding the recording paper 6 to be printed (recorded) by the recording head 12 in the medium feeding direction perpendicular to the head scanning direction.

Next, by referring to FIGS. 2 to 6, the recording head (liquid ejecting head) 12 of the ink jet recording apparatus of this embodiment will be described in detail.

Figure 2:
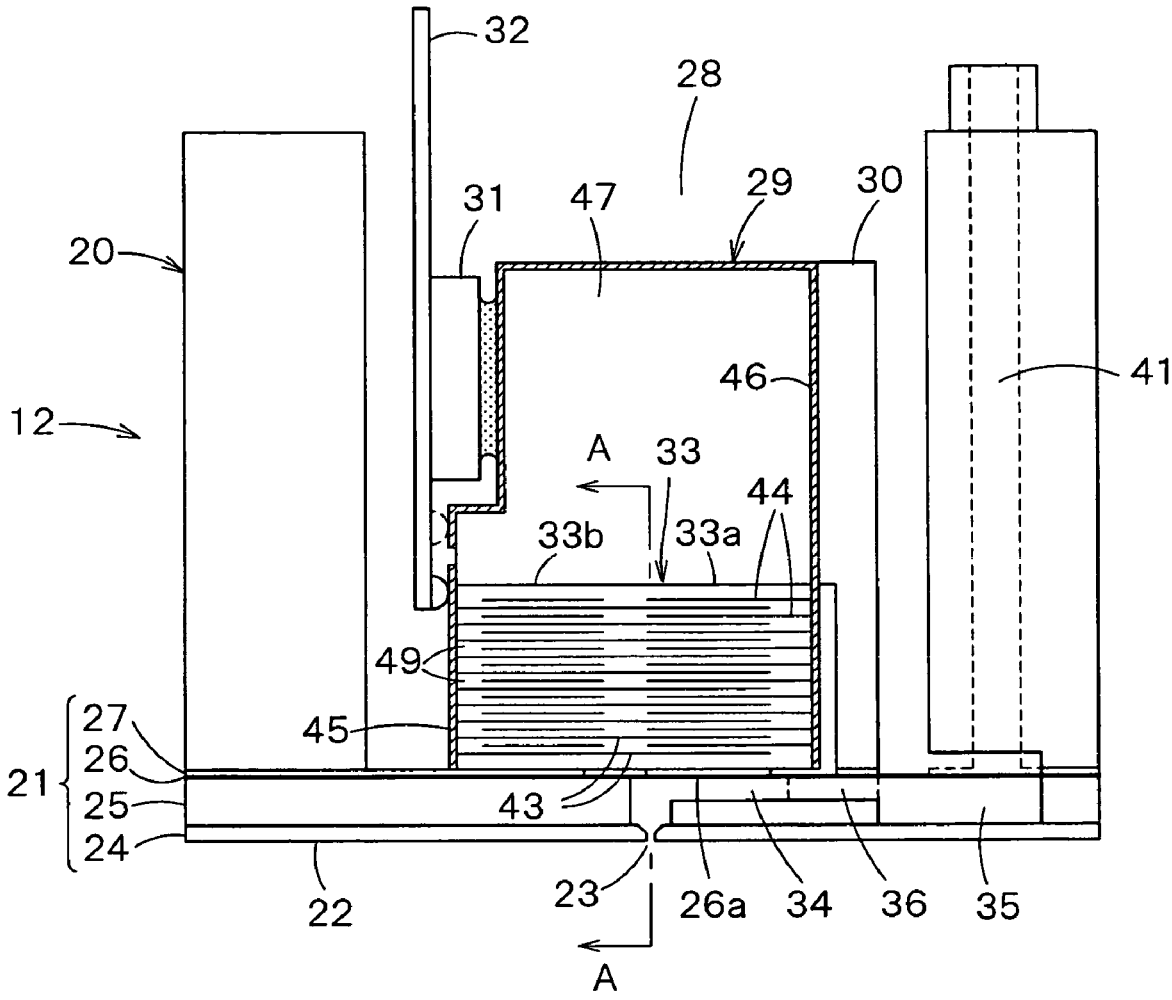
FIG. 2 is a vertical sectional view showing the enlarged recording head of the ink jet recording apparatus shown in FIG. 1.
Figure 3:
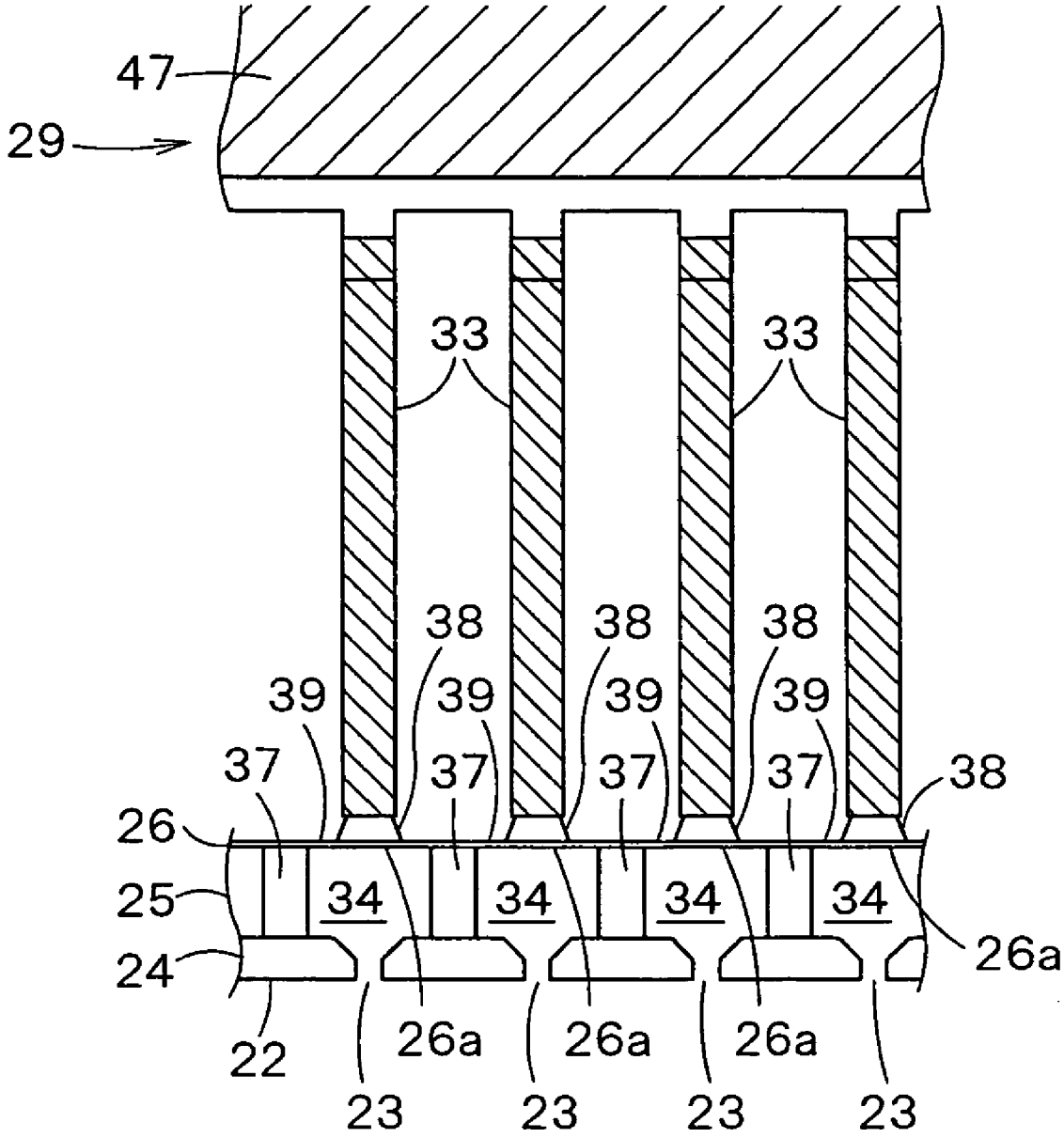
FIG. 3 is a sectional view of the line A—A shown in FIG. 2.

As shown in FIG. 2 and FIG. 3 which is the sectional view of the line A—A shown in FIG. 2, the recording head 12 has a case 20 made of synthetic resin and a flow path unit 21 stuck on the bottom of the case 20. The case 20 is formed by general plastics without using a reinforced material like a conventional recording head. The flow path unit 21 is formed by laminating a nozzle plate 24 having many bored nozzle openings 23 in line, a flow path forming plate 25 made of silicon, an elastic plate 26, and a vibration plate 27 and unifying them by adhesion.

Figure 4:
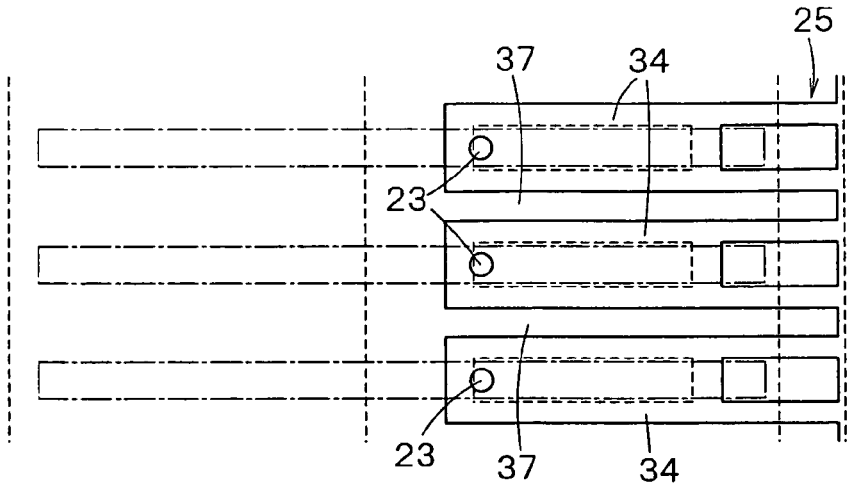
FIG. 4 is a drawing showing the arrangement constitution of the nozzle openings, pressure chambers, and ink flow path of the recording head shown in FIG. 2.

As shown in FIG. 4, the nozzle plate 24 is a thin laminal member in which many nozzle openings 23 are bored in one row in the nozzle forming direction (the sub-scanning direction) and the bottom of the nozzle plate 24 forms a nozzle forming face 22 (FIG. 2).

The case 20 is a block member in which a storing space 28 opened on the top and bottom is formed. In the storing space 28, a piezoelectric actuator unit 29 and a fixing member (unit fixing member) 30 for fixing the piezoelectric actuator unit 29 to the flow path unit 21 are stored. The fixing member 30 is formed by free-cutting ceramics.

To the piezoelectric actuator unit 29, a tape carrier package 32 having a drive integrated circuit 31 is electrically connected. One face of the drive integrated circuit 31 is stuck to the piezoelectric actuator unit 29, thereby a cooling effect for the drive integrated circuit 31 is obtained.

Figure 6:
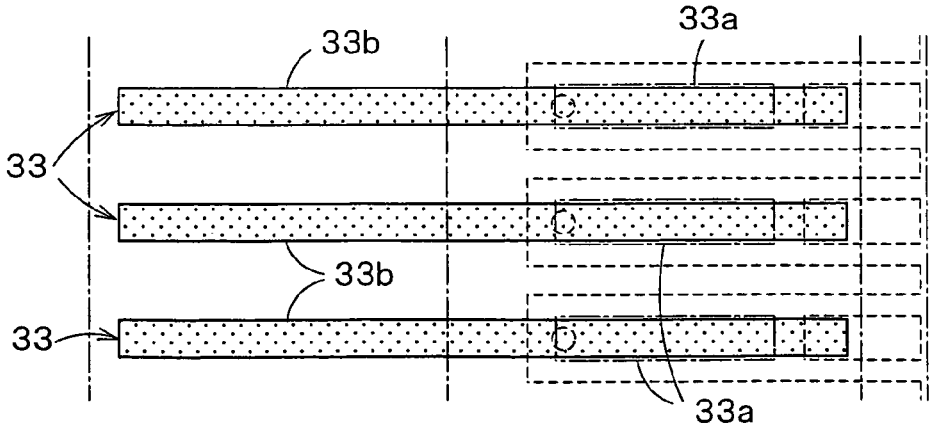
FIG. 6 is a drawing showing the arrangement constitution of the piezoelectric vibrators of the recording head shown in FIG. 2.

As shown in FIGS. 3 and 6, the piezoelectric actuator unit 29 has a plurality of piezoelectric vibrators 33 made of PZT arranged in one row. The piezoelectric vibrators 33, as shown in FIG. 2, are composed of individual electrode layers 43, common electrode layers 44, and piezoelectric material layers 49 which are alternately laminated in the direction perpendicular to the nozzle forming face 22, vibrate in the lamination direction of both layers, and have a piezoelectric strain constant d33. The individual electrode layers 43 are electrode layers of the piezoelectric vibrators 33 on the drive voltage input side and the common electrode layers 44 are electrode layers on the reference potential side.

Each of the individual electrode layers 43 is exposed on one side (the side on the left of FIG. 2) of each of the piezoelectric vibrators 33 and each of individual external electrodes 45 is electrically connected to the exposed part of each of the individual electrode layers 43. Further, each of the common electrode layers 44 is exposed on the other side (the side on the right of FIG. 2) of each of the piezoelectric vibrators 33 and each of common external electrodes 46 is electrically connected to the exposed part of each of the common electrode layers 44. The common external electrodes 46 are electrically connected commonly to all the common electrode layers 44 of the plurality of vibrators 33.

The piezoelectric actuator unit 29 has a base member 47 installed on the upper part of the plurality of piezoelectric vibrators 33 and the plurality of piezoelectric vibrators 33 which are separated and formed independently from each other are integrally fixed by the base member 47. The base member 47 is formed by free-cutting ceramics.

Further, as a modified example, a constitution that the cutting-in depth when forming the plurality of piezoelectric vibrators 33 is made slightly shallow, and the cutting is stopped before reaching the base member 47, and the plurality of piezoelectric vibrators 33 are joined to each other on the upper part thereof may be used.

In either case, the upper part of the piezoelectric unit 29 is formed by the base member 47 made of ceramics without using an expensive piezoelectric material and electrode material, thereby the manufacturing cost of the piezoelectric unit 29 can be controlled.

The common external electrodes 46 pass through the side and top of the base member 47 and are pulled out up to the side of the individual external electrodes 45. The drive integrated circuit 31 of the tape carrier package 32 is fixed to the side of the base member 47 on the side of the individual external electrodes 45.

And, in this embodiment, as shown in FIG. 2, the lamination area of the individual electrode layers 43 and the common electrode layers 44 is limited to a half on one side of each of the piezoelectric vibrators 33 in the width direction, thereby the piezoelectric vibrators 33 respectively have the active parts 33*a* capable of performing piezoelectric deformation and the inactive parts 33*b* incapable of performing piezoelectric deformation. Further, in FIG. 2, also in the inactive parts 33*b*, the electrode layers are displayed in the same plane as that of the common electrode layers 44. However, the electrode layers are electrically interrupted from the common electrode layers 44 and are just used to make the active parts 33*a* and the inactive parts 33*b* equal to each other in thickness.

Further, the recording head 12 of this embodiment is structured so that the total width of the inactive parts 33*b* in the vibrator width direction perpendicular to the arrangement direction of the plurality of nozzle openings 23 and the fixing member 30 is made wider than the width of the active parts 33*a* in the vibrator width direction. By doing this, the strength on the fixing end side is ensured sufficiently and the force generated when the piezoelectric vibrators 33 are driven will not be absorbed at the fixing end.

As shown in FIGS. 2, 3, and 4, on the flow path forming plate 25, a plurality of pressure chambers 34, a common ink chamber 35 formed for each ink kind, and ink feed ports 36 for interconnecting the pressure chambers 34 and the common ink chambers 35 for each of the pressure chambers 34 are formed. The pressure chambers 34 are isolated by partitions 37.

Figure 5:
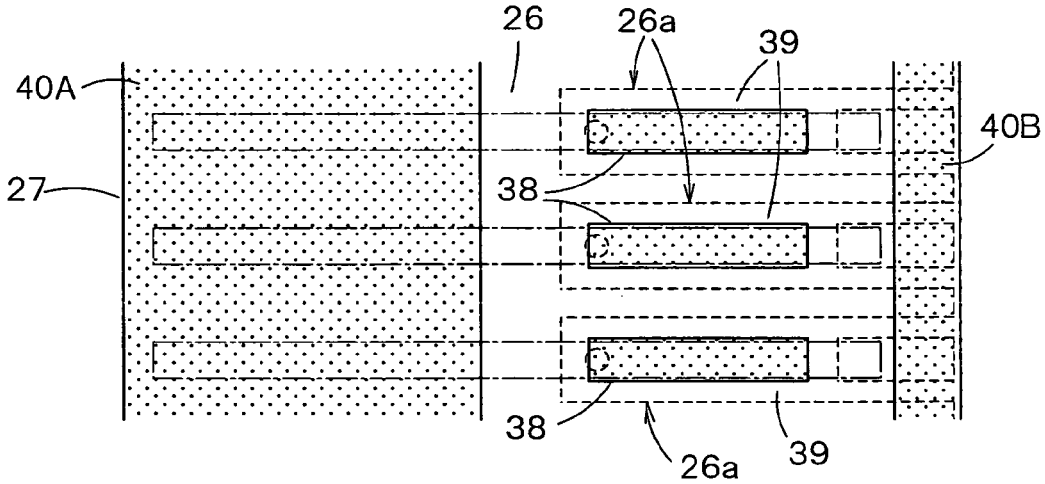
FIG. 5 is a drawing showing the arrangement constitution of the movable thick parts and fixed thick parts of the recording head shown in FIG. 2.

As shown in FIGS. 3 and 5, the opening on the top of each of the pressure chambers 34 is sealed by each of elastic walls 26*a* composed of a part of the single elastic plate 26. The elastic wall 26*a* is deformed according to the deformation of the piezoelectric vibrator 33 of the piezoelectric actuator unit 29, thereby the volume of the pressure chamber 34 is changed and ink drops can be ejected from the nozzle opening 23.

As FIGS. 3 and 5 show, insular movable thick parts 38 to which the tips of the active parts 33*a* (shown in FIG. 2) of the piezoelectric vibrators 22 are joined, elastic thin parts (compliance parts) 39 formed so as to surround the movable thick parts 38, a first fixed thick part 40A to which the tips of the inactive parts 33*b* (shown in FIG. 2) of the plurality of piezoelectric vibrators 33 are joined, and a second fixed thick part 40B to which the tip of the fixing member 30 is joined are formed by the elastic plate 26 and the vibration plate 27.

As FIGS. 2 and 5 show, the piezoelectric actuator unit 29 is fixed to the top of the flow path unit 21 by the inactive parts 33*b* of the plurality of piezoelectric vibrators 33 and the fixing plate 30, and the case 20 and the piezoelectric actuator unit 29 are not fixed to each other. As mentioned above, according to this embodiment, the inactive parts 33*b* of the plurality of piezoelectric vibrators 33 and the fixing plate 30 form a unit fixing part for fixing the piezoelectric actuator unit 29 to the flow path unit 21.

As shown in FIG. 2, in the case 20, an ink feed path 41 for feeding ink to the common ink chambers 35 is formed for each ink kind. The ink feed paths 41 pass through the elastic plate 26 and the vibration plate 27 and interconnect to the common ink chambers 35.

As mentioned above, according to this embodiment, the piezoelectric actuator unit 25 and the flow path unit 21 are fixed by the inactive parts 33*b* of the piezoelectric vibrators 33 on one side with respect to the pressure chamber row and are fixed by the fixing member 30 on the other side with respect to the pressure chamber row. Therefore, the loop of force generated when the piezoelectric vibrators 33 are expanded and contracted is completed in the piezoelectric actuator unit 29 and the flow path unit 21, thereby the deformation amount of the flow path unit 21 is reduced and the cross talk is suppressed.

Further, unlike a conventional recording head, there is no need to fix the piezoelectric actuator unit 29 to the case 20, so that the requirements for rigidity and dimensional accuracy to the case 20 are reduced, and the degree of freedom of material and structure of the case 20 is increased, thereby the manufacturing cost of the case 20 can be decreased.

Furthermore, according to this embodiment, by the flow path forming plate 25 made of silicon, the piezoelectric vibrators 33 made of PZT, and the base member 47 and the fixing member 30 which are made of free-cutting ceramics, the surrounding of the drive part is formed, and these members are made of materials which have coefficients of linear expansion close to each other and cause no swell due to moisture absorption, so that the members are not separated from each other and high reliability can be ensured.

Figure 7:
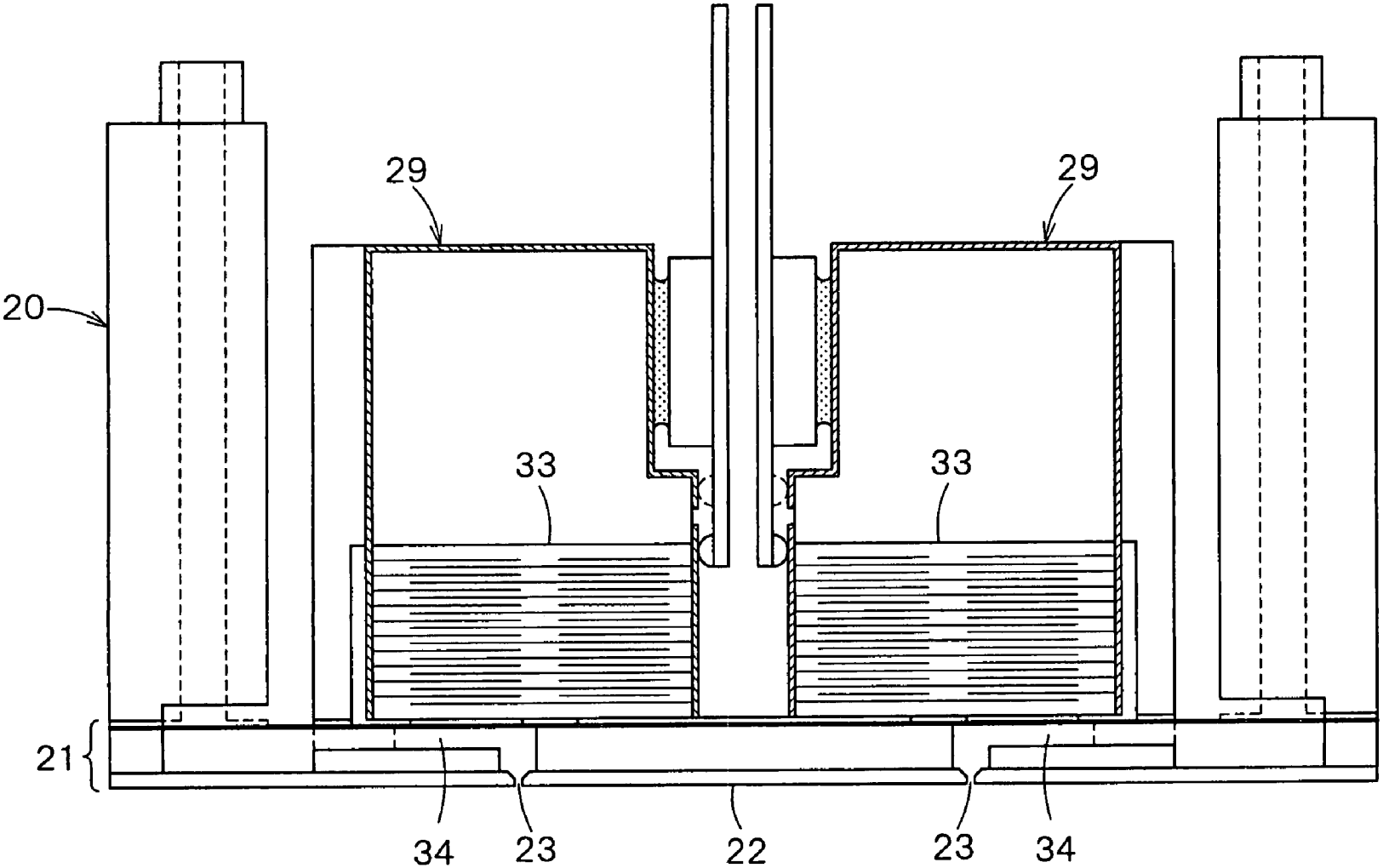
FIG. 7 is a vertical sectional view showing a recording head of a liquid ejecting apparatus of another embodiment of the present invention.

Another embodiment of the present invention may have a constitution shown in FIG. 7, in one recording head, two or more piezoelectric actuator units 29 are installed, and two or more rows composed of a plurality of nozzle openings 23 and pressure chambers 34 are formed, and the piezoelectric actuator units 29 correspond to each row.

As shown in FIG. 7, the tape carrier package 32 is pulled out vertically, so that even if the number of piezoelectric actuator units 29 to be installed is increased as mentioned above, wires can be easily laid.

According to this embodiment shown in FIG. 7, the loop of force generated when the piezoelectric vibrators 33 are driven is completed in the piezoelectric actuator unit 29 and the flow path unit 21 thereof, thereby the cross talk between the pressure chamber rows can be prevented.

Figure 8:
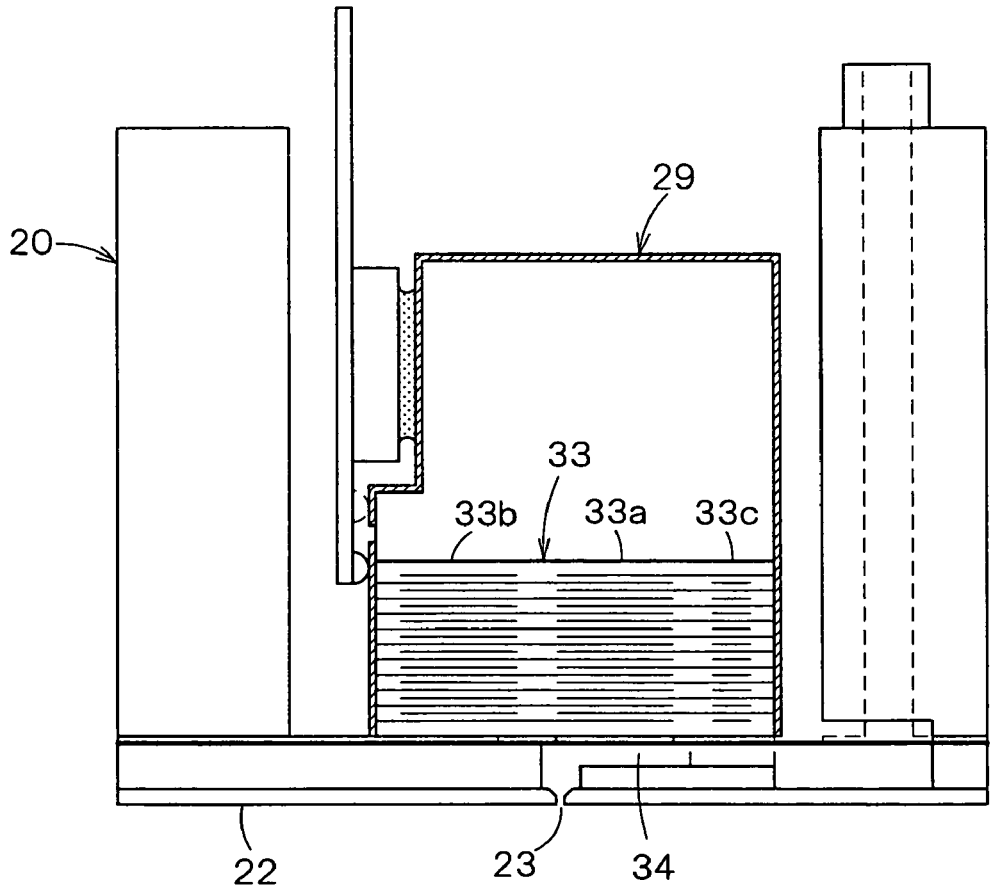
FIG. 8 is a vertical sectional view showing a recording head of a liquid ejecting apparatus of still another embodiment of the present invention.
Figure 9:
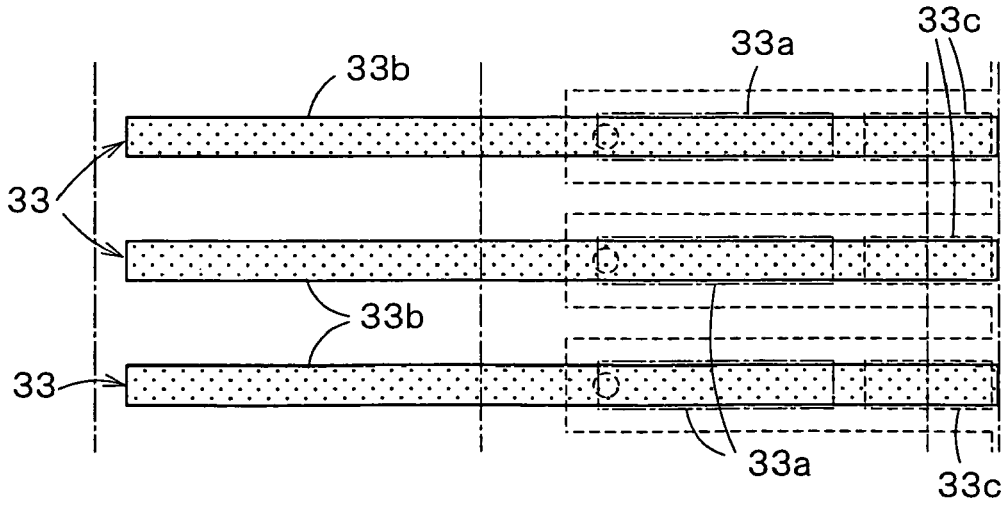
FIG. 9 is a drawing showing the arrangement constitution of the piezoelectric vibrators of the recording head shown in FIG. 8.

In still another embodiment of the present invention, as shown in FIGS. 8 and 9, in place of the fixing member 30 shown in FIG. 2, additional inactive parts 33*c* are formed integrally with the active parts 33*a* as a part of the piezoelectric vibrators 33 on the side in the vibrator width direction opposite to the side of the inactive parts 33*b* while sandwiching the active parts 33*a* of the piezoelectric vibrators 33. And, the additional active parts 33*c* are joined to the second fixed thick part 40B shown in FIG. 5.

This embodiment can produce the same effect as that of the embodiment shown in FIG. 2. Further, the operation of forming the fixing member 30 separately from the piezoelectric actuator unit 29 and joining it to the piezoelectric actuator unit 29 is not required and the manufacturing steps can be simplified.

Figure 10:
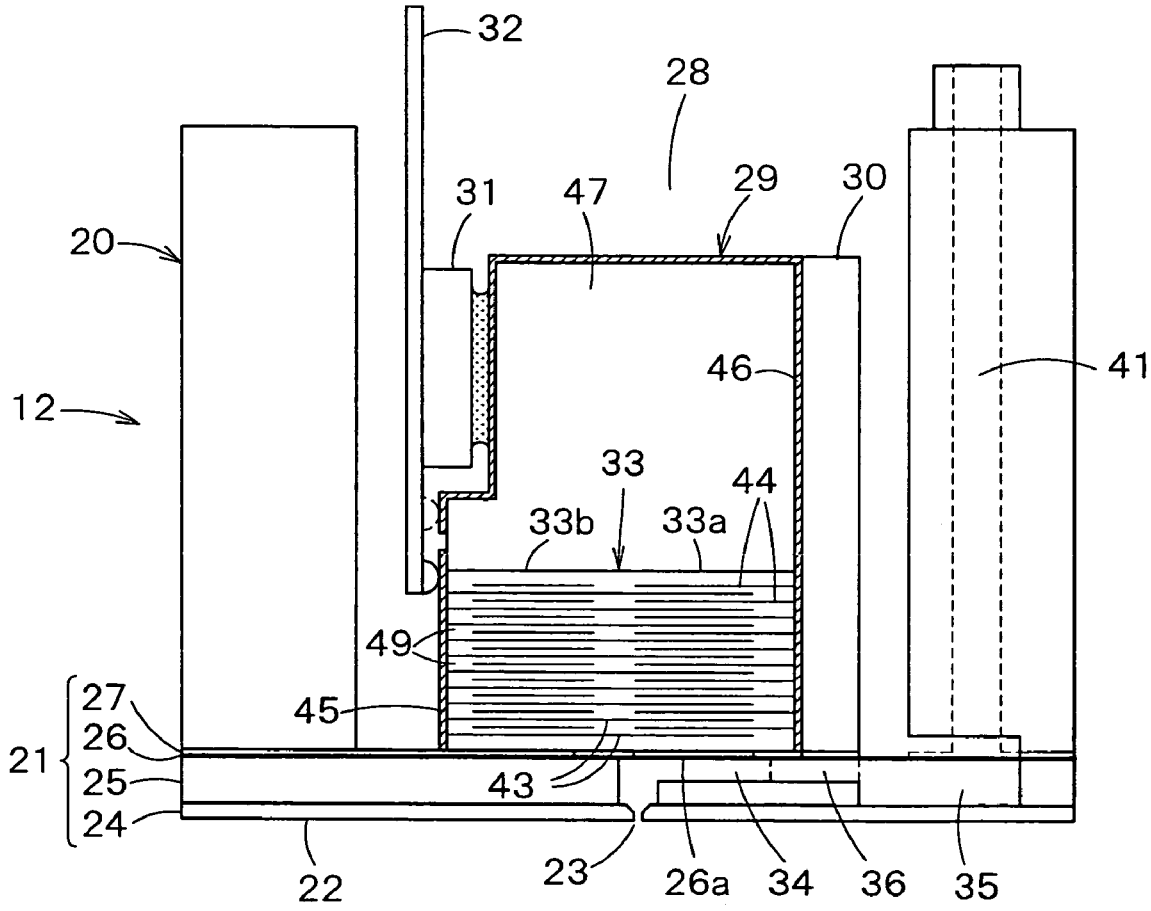
FIG. 10 is a vertical sectional view showing a recording head of a liquid ejecting apparatus of a modified example of the embodiment shown in FIG. 2.

Further, FIG. 10 shows a modified example of the embodiment shown in FIG. 2 and in this modified example, the fixing member 30 is joined to not only the base member 47 but also the ends of the active parts 33*a* of the piezoelectric vibrators 33. And, the parts of the fixing member 30 joined to the ends of the active parts 33*a* are formed integrally with the plurality of piezoelectric vibrators 33 in a comb-teeth shape.

An example of the ink jet recording apparatus which is a kind of liquid ejecting apparatus is explained above. However, the present invention can be applied to a liquid ejecting apparatus having other liquid ejecting heads such as a liquid crystal ejecting head or a coloring material ejecting head.

Figure 11:
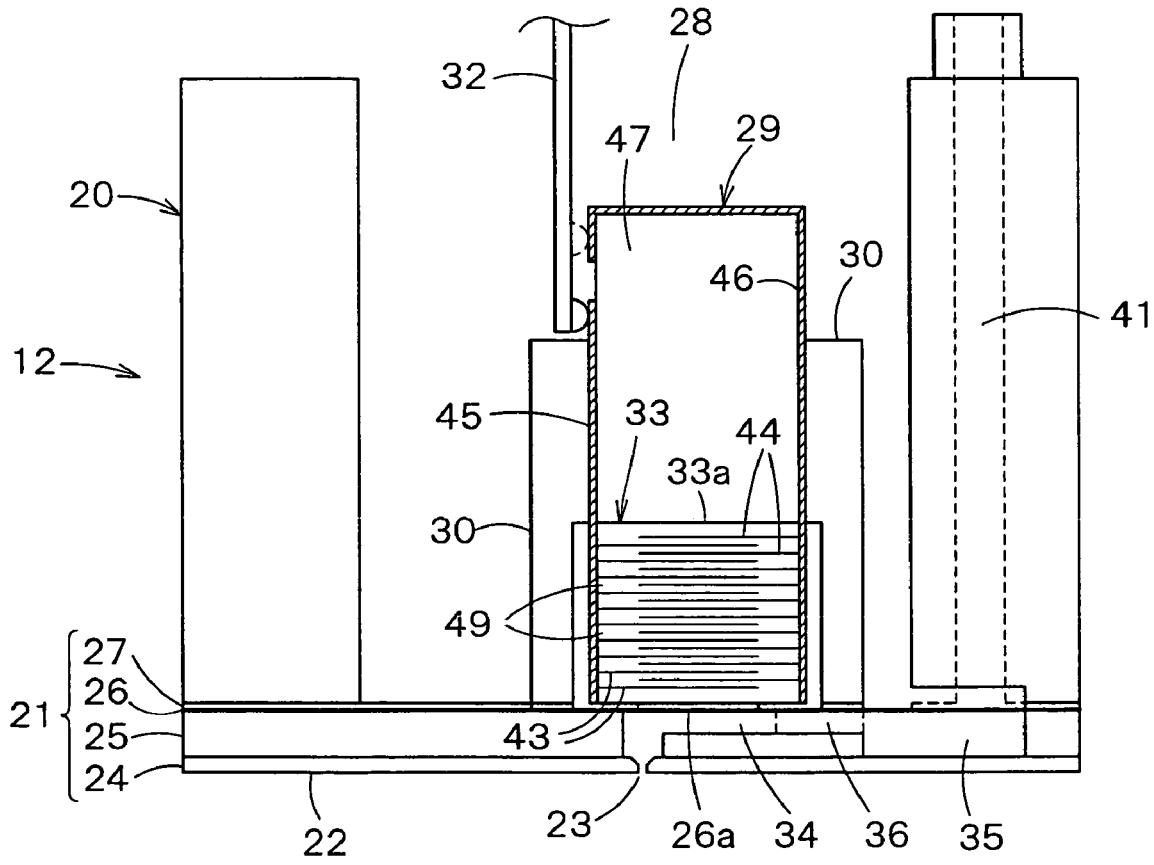
FIG. 11 is a vertical sectional view showing a recording head of a liquid ejecting apparatus of another modified example of the embodiment shown in FIG. 2.

Further, FIG. 11 shows another modified example of the embodiment shown in FIG. 2 and in this modified example, the piezoelectric vibrators 33 are composed of only the active parts 33*a* with the inactive parts 33*b* thereof omitted. And, in the parts in which the inactive parts 33*b* are omitted, another fixing member 30 is installed and the base member 47 is fixed so as to be held between a pair of fixing members 30 on both sides in the vibrator width direction.

In this modified example, after the plurality of piezoelectric vibrators 33 are processed in a comb-teeth shape, the fixing members 30 may be stuck on the base member 47 or the fixing members 30 are stuck on the base member 47 beforehand and then the fixing members 30 may be processed in a comb-teeth shape together with the piezoelectric vibrators 33. Further, the fixing members 30 may be formed so as to make the tops of the fixing members 30 and the top of the base member 47 flush with each other.

Figure 12:
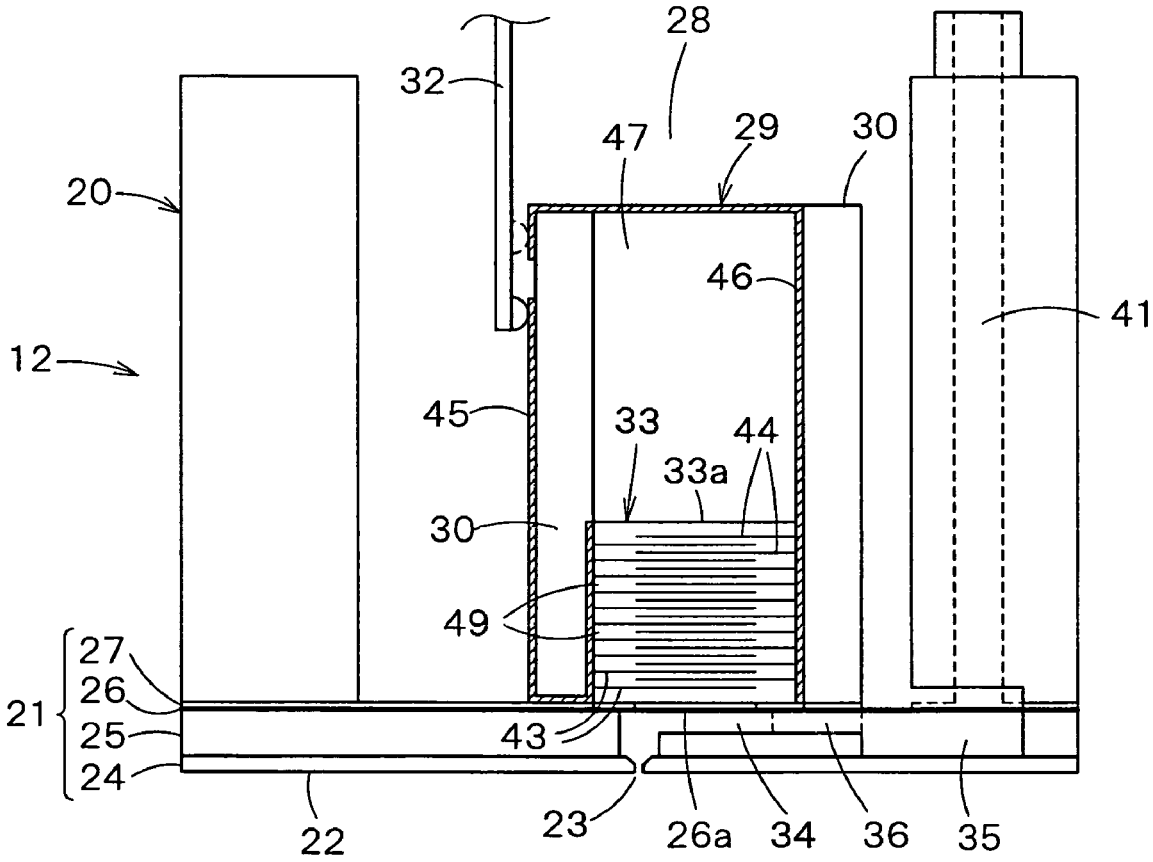
FIG. 12 is a vertical sectional view showing a recording head of a liquid ejecting apparatus of still another modified example of the modified example shown in FIG. 11.

Further, FIG. 12 shows still another modified example of the modified example shown in FIG. 11 and in this modified example, each of the pair of fixing members 30 is joined to not only the base member 47 but also each end of the active parts 33*a* of the piezoelectric vibrators 33.

In this modified example, when forming the plurality of vibrators 33 by the comb-teeth process, the fixing members 30 are simultaneously processed in a comb-teeth shape.

Figure 13:
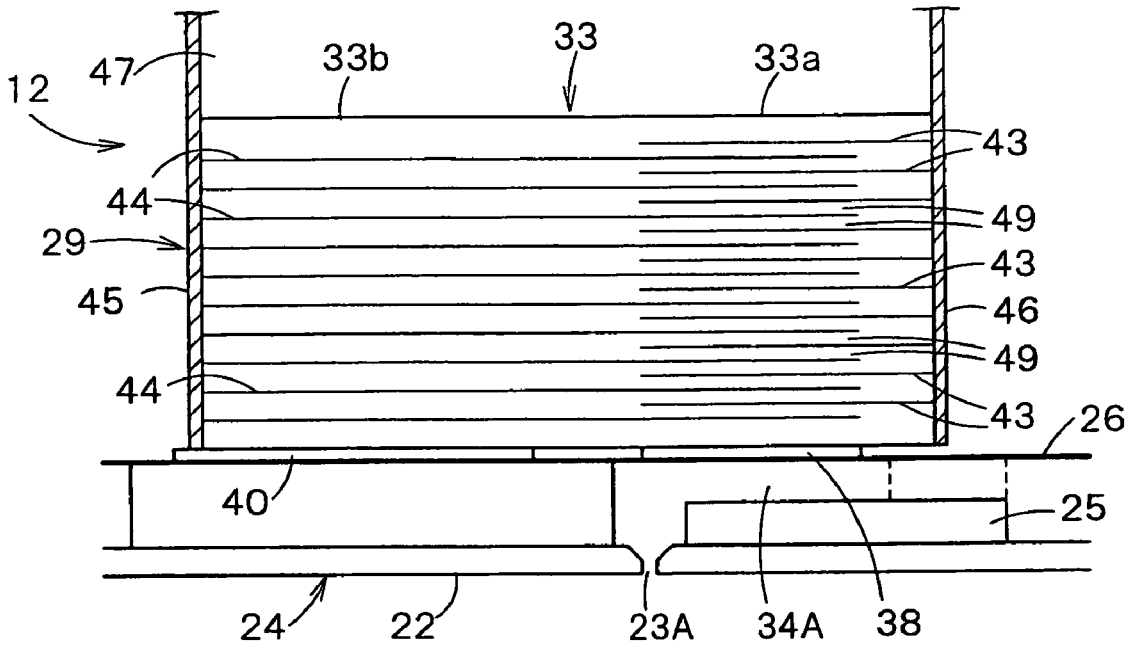
FIG. 13 is a vertical sectional view showing a recording head of a liquid ejecting apparatus of a further modified example of the embodiment shown in FIG. 2.
Figure 14:
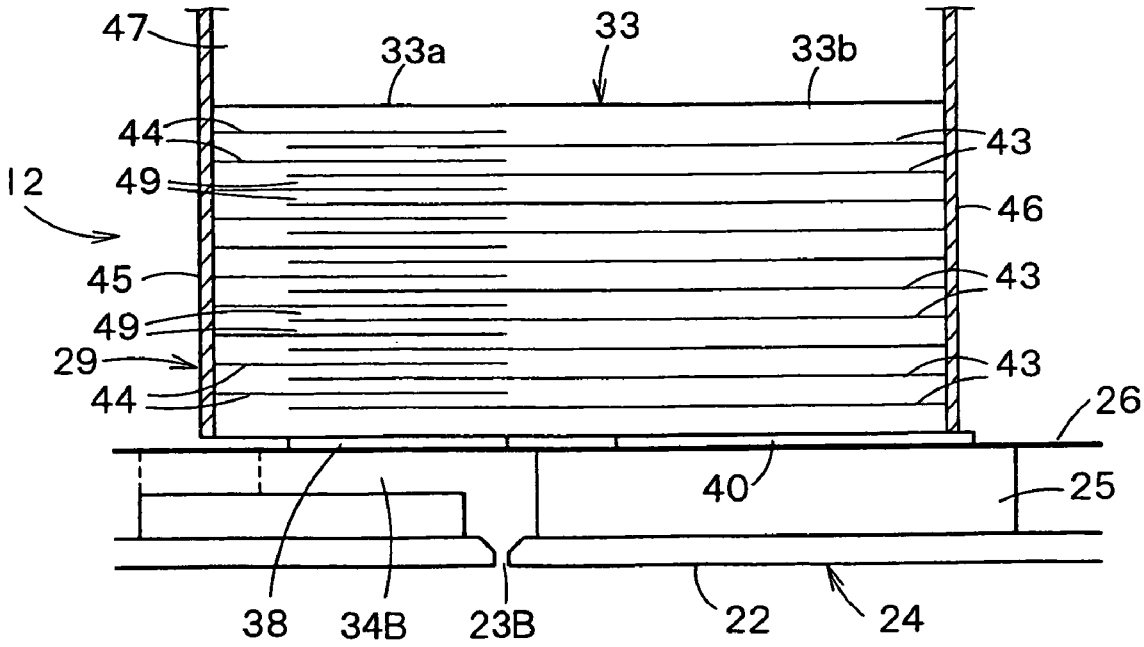
FIG. 14 is a vertical sectional view in which the position of the section of the recording head shown in FIG. 13 is changed.
Figure 15:
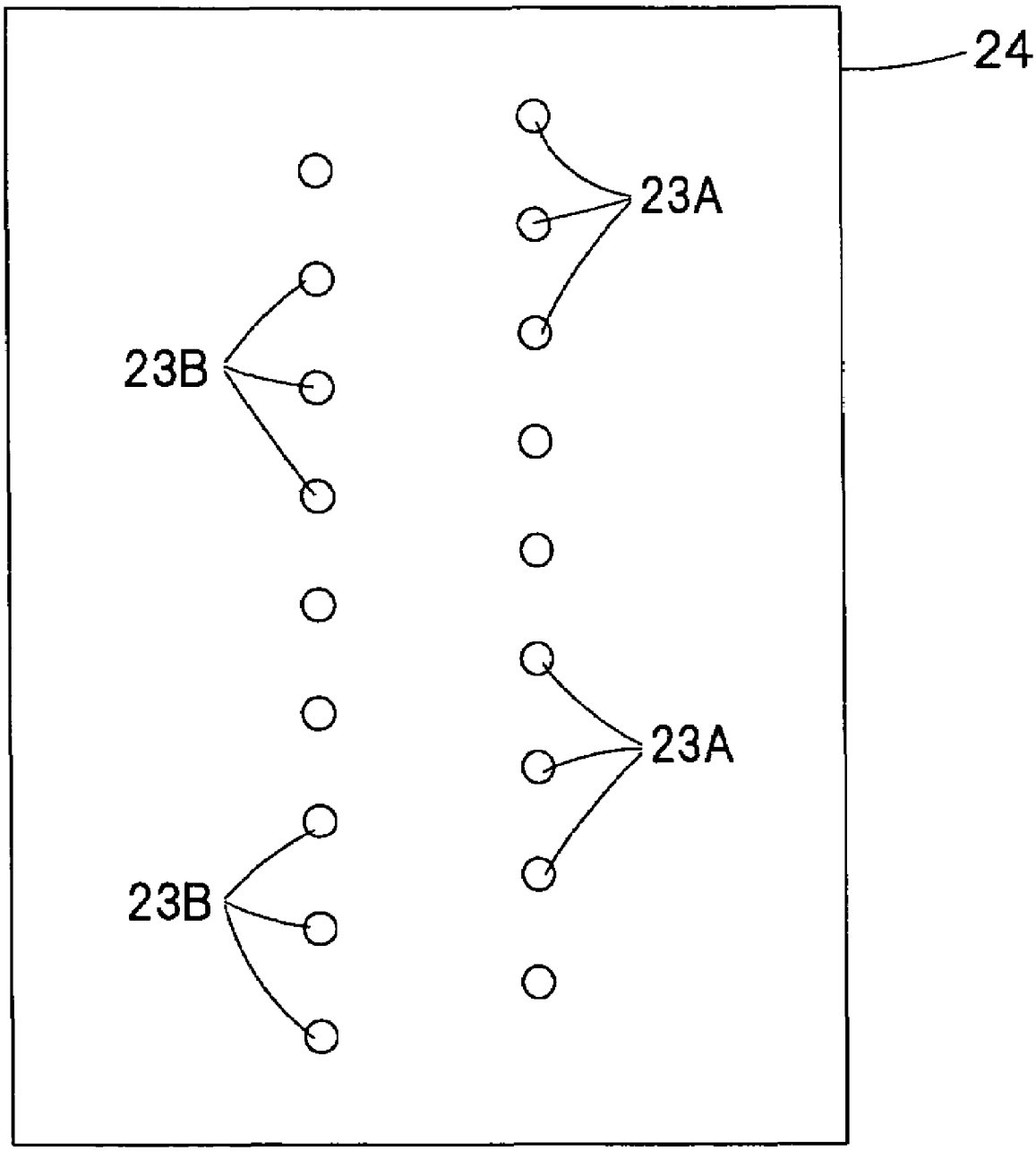
FIG. 15 is a plan view for explaining the nozzle arrangement of the recording head shown in FIGS. 13 and 14.
Figure 16:
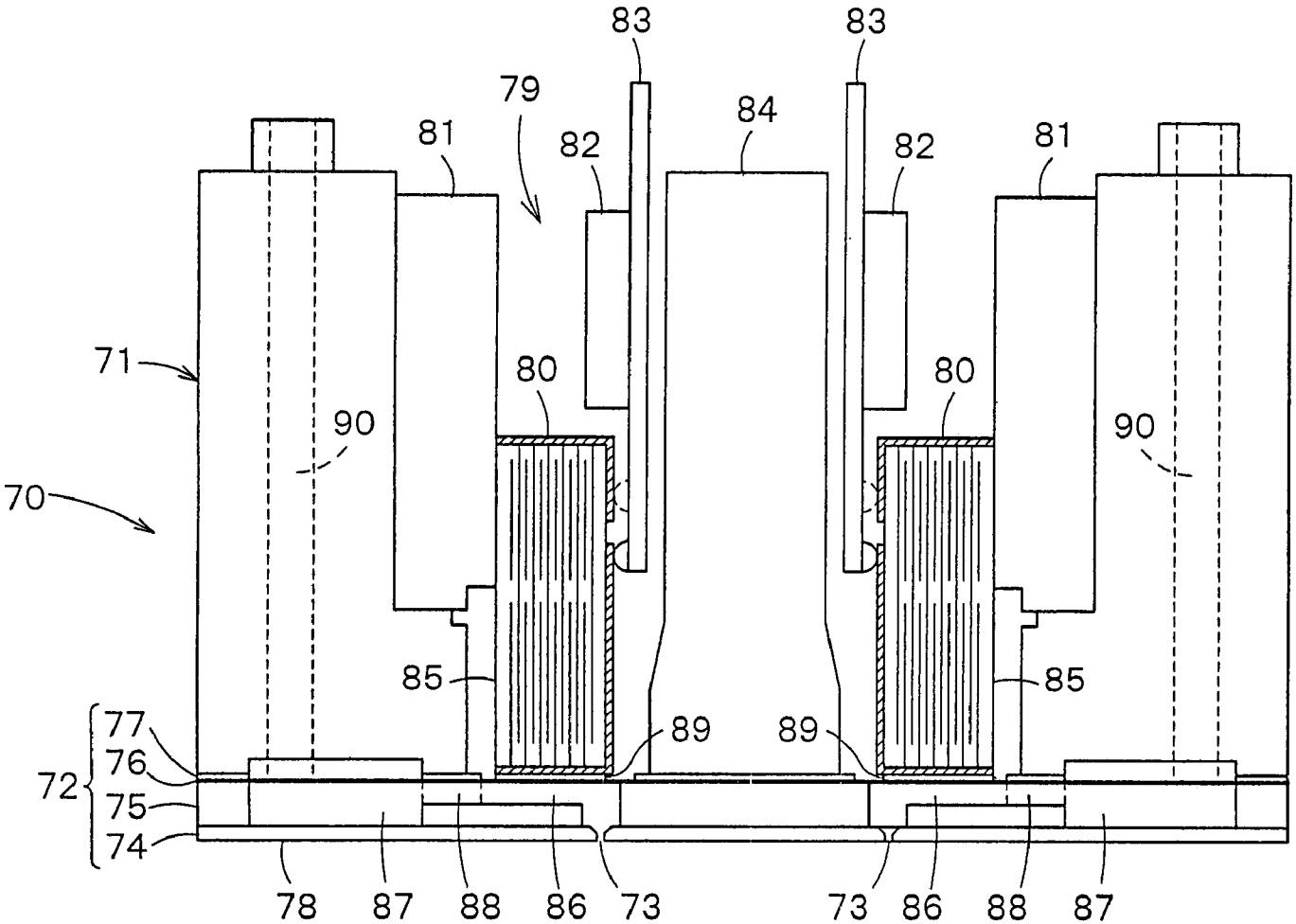
FIG. 16 PRIOR ART
FIG. 16 is a vertical sectional view showing the recording head of a conventional ink jet recording apparatus.
Figure 17:
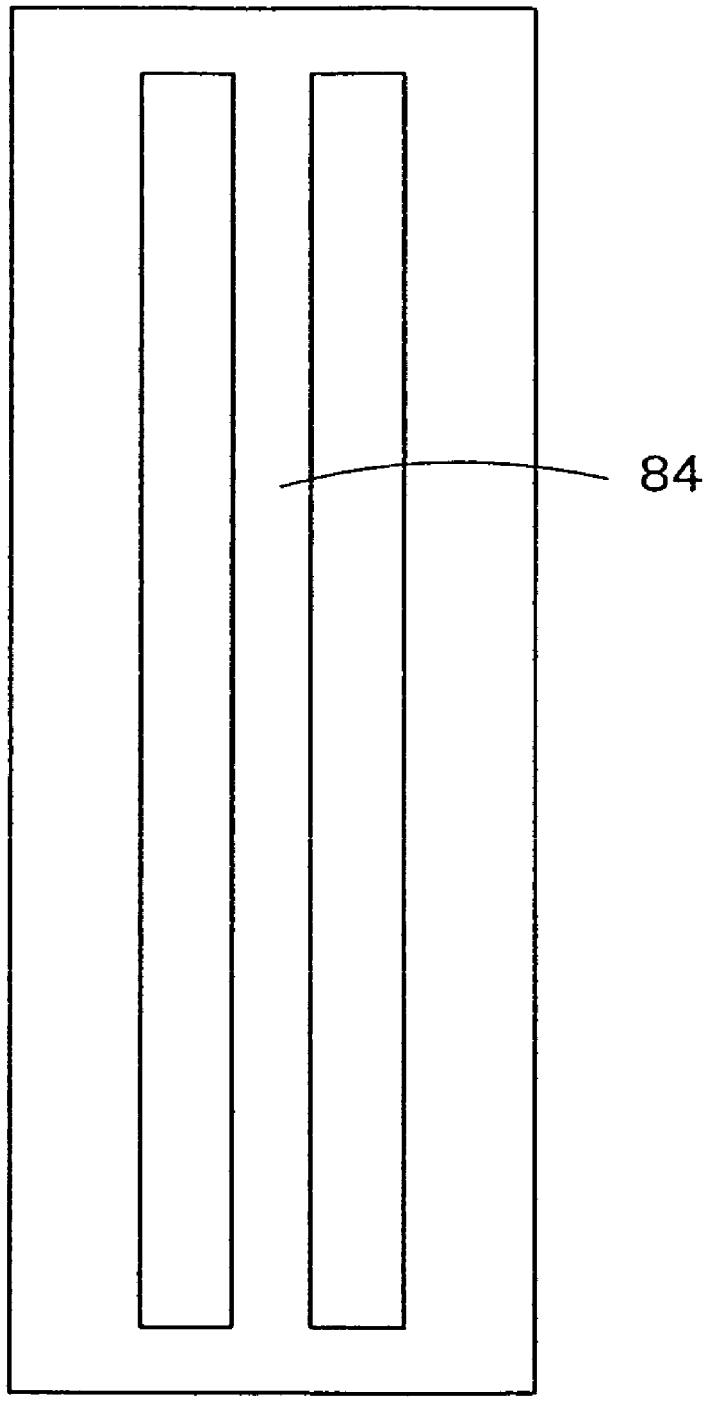
PRIOR ART FIG. 17
FIG. 17 is a plan view for explaining the arrangement of the central rib of the recording head of the conventional ink jet recording apparatus shown in FIG. 16.

Further, FIGS. 13 and 14 show still another modified example of the embodiment shown in FIG. 2. In this modified example, as shown in FIG. 15, a plurality of nozzle openings 23A and 23B are formed in two rows and between the nozzle rows, the nozzle openings 23A and 23B are alternately arranged in a zigzag shape. The plurality of pressure chambers 34A and 34B, in correspondence to the arrangement of the nozzle openings 23A and 23B, are also alternately arranged in a zigzag shape.

Each of the plurality of piezoelectric vibrators 33 includes a half on one side in the vibrator width direction and a half on the other side in the vibrator width direction, and either of the half on one side and the half on the other side forms the active parts, and the other half forms the inactive parts incapable of performing piezoelectric deformation.

And, in the adjacent piezoelectric vibrators 33, the arrangement of the active parts and inactive parts is opposite, and the active parts are arranged in correspondence with the nozzle openings 23A and 23B. Further, in this modified example, the plurality of fixed thick parts 40 are formed in an insular shape in correspondence with the respective inactive parts 33*b* of the plurality of piezoelectric vibrators 33 and arranged in a zigzag shape.

Also in this modified example, as shown in FIG. 11, the fixing members 30 may be arranged on both sides of the piezoelectric vibrators 33.

The preferred embodiments of the present invention are described above in detail to a certain degree. However, it is clear that many changes and modifications can be made. Therefore, it can be understood that without being deviated from the scope and spirit of the present invention, in configurations other than those specifically described here, the present invention can be executed.

What is claimed is:

1. A liquid ejecting apparatus comprising:

a liquid ejecting head having a plurality of nozzle openings for ejecting liquid drops arranged in line, wherein:

said liquid ejecting head has a flow path unit having a plurality of pressure chambers respectively interconnected to said plurality of nozzle openings, a plurality of elastic walls for respectively forming one face of each of said plurality of pressure chambers, and a nozzle plate where said plurality of nozzle openings are formed and a piezoelectric actuator unit which includes a plurality of piezoelectric vibrators respectively joined to said plurality of elastic walls via insular parts, deforms said elastic walls by deformation of said piezoelectric vibrators, and changes the volume of said pressure chambers, said plurality of piezoelectric vibrators are respectively formed by alternately laminating piezoelectric material layers and electrode layers and have active parts capable of performing piezoelectric deformation which are joined to said elastic walls, and said piezoelectric actuator unit further has a pair of unit fixing parts installed on both sides of said active parts in a vibrator width direction perpendicular to an arrangement direction of said plurality of nozzle openings, and said pair of unit fixing parts are joined to parts of said flow path unit other than said plurality of elastic walls of said flow path unit, thereby said piezoelectric actuator unit is fixed to said flow path unit, wherein at least one of said pair of unit fixing parts comprises a plurality of inactive parts incapable of performing piezoelectric deformation formed integrally with said active parts in said vibrator width direction as a part of each of said plurality of piezoelectric vibrators, wherein said piezoelectric material layers and said electrode layers are laminated perpendicularly to said nozzle plate and said piezoelectric vibrators vibrate in a lamination direction of both layers, and wherein at least one of said pair of unit fixing parts is joined to an end of said active part in said vibrator width direction and parts of said fixing members joined to said ends of said active parts are formed integrally with said plurality of piezoelectric vibrators in a comb-teeth shape.

2. A liquid ejecting apparatus according to claim 1, wherein at least one of said pair of unit fixing parts comprises a fixing member which is formed as a separate member from said plurality of piezoelectric vibrators and is joined to said plurality of piezoelectric vibrators.

3. A liquid ejecting apparatus according to claim 2, wherein said fixing member is joined to said plurality of piezoelectric vibrators via a base member joined to said plurality of piezoelectric vibrators.

4. A liquid ejecting apparatus according to claim 3, wherein said plurality of piezoelectric vibrators are respectively formed independently and are integrally fixed by said base member.

5. A liquid ejecting apparatus according to claim 3 or 4, further comprising a tape carrier package electrically connected to said plurality of piezoelectric vibrators, wherein said tape carrier package includes an integrated circuit for driving said plurality of piezoelectric vibrators and a rear of said integrated circuit is fixed to said base member at least partially.

6. A liquid ejecting apparatus according to claim 3, wherein said base member is formed by free-cutting ceramics.

7. A liquid ejecting apparatus according to claim 1, further comprising a plurality of said piezoelectric actuator units, wherein:

a plurality of nozzle rows composed of said plurality of nozzle openings are formed, and said piezoelectric actuator units are respectively arranged for each nozzle row.

8. A liquid ejecting apparatus according to claim 1, wherein:

said plurality of elastic walls comprise a part of an elastic plate covering all of said plurality of pressure chambers, and a plurality of insular movable thick parts which are formed in correspondence with said plurality of pressure chambers and to which respective said active parts of said plurality of piezoelectric vibrators are joined, first fixed thick parts to which said inactive parts of said piezoelectric vibrators are joined, and second fixed thick parts to which said unit fixing parts are joined are installed on a face of said elastic plate on a side of said actuator unit.

9. A liquid ejecting apparatus according to claim 1, wherein a total width of said pair of unit fixing parts in said vibrator width direction is wider than a width of said active part in said vibrator width direction.

10. A liquid ejecting apparatus according to claim 1, wherein:

said plurality of nozzle openings are formed in two rows and are staggered between said nozzle rows, and each of said plurality of piezoelectric vibrators includes a half on one side in said vibrator direction and a half on the other side in said vibrator width direction, either of said half on one side and said half on the other side forms said active part, and the other half forms an inactive part incapable of performing piezoelectric deformation, an arrangement of said active part and said inactive part is opposite between adjacent piezoelectric vibrators, and said active parts are arranged in correspondence with said nozzle openings.

* * * * *